US008173882B2

(12) United States Patent
Hannapel

(10) Patent No.: US 8,173,882 B2
(45) Date of Patent: May 8, 2012

(54) TREMOLO ASSEMBLY OF STRINGED INSTRUMENT

(76) Inventor: William J. Hannapel, Richland, MI (US)

( * ) Notice: Subject to any disclaimer, the term of this patent is extended or adjusted under 35 U.S.C. 154(b) by 135 days.

(21) Appl. No.: 12/768,013

(22) Filed: Apr. 27, 2010

(65) Prior Publication Data

US 2011/0259172 A1 Oct. 27, 2011

(51) Int. Cl.
*G10D 3/00* (2006.01)

(52) U.S. Cl. ..... 84/313

(58) Field of Classification Search ..... 84/313
See application file for complete search history.

(56) References Cited

U.S. PATENT DOCUMENTS 3,326,072 A * 6/1967 Price ..... 84/313
3,512,443 A * 5/1970 Parson et al. ..... 84/313
4,317,403 A * 3/1982 Franzmann ..... 84/313
4,852,448 A * 8/1989 Hennessey ..... 84/313
5,400,684 A * 3/1995 Duffy ..... 84/313
5,907,114 A * 5/1999 Culver ..... 84/313
6,194,645 B1 * 2/2001 Rose ..... 84/313
7,259,309 B1 * 8/2007 Lovelace et al. ..... 84/313
2011/0259172 A1 * 10/2011 Hannapel ..... 84/313

* cited by examiner

*Primary Examiner* — Elvin G Enad
*Assistant Examiner* — Robert W Horn
(74) *Attorney, Agent, or Firm* — Bliss McGlynn, P.C.

(57) ABSTRACT

A stringed instrument defines a hollow volume and includes at least one string. A tremolo assembly of the stringed instrument is adapted to vary tension in the string and comprises a tone block disposed within the hollow volume and operatively connected to the string. An arm extends from the tone block and is disposed within the volume of space. A handle extends from the arm and is spaced from the tone block and adapted to be displaced relative to the arm to operatively cause the tone block to correspondingly vary the tension in the string. A bridge plate is attached to the stringed instrument, connected to the string and tone block, and operatively connected to the arm. A connection mechanism operatively connects the bridge plate to the arm and is adapted to pull the bridge plate away from and toward the stringed instrument to correspondingly vary the tension upon the displacement.

16 Claims, 2 Drawing Sheets

TREMOLO ASSEMBLY OF STRINGED INSTRUMENT

BACKGROUND OF INVENTION

1. Field of Invention

The invention relates, generally, to a tremolo assembly of a stringed instrument and, more particularly, to placement of the tremolo assembly of a guitar relative to a remainder of the guitar.

2. Description of Related Art

A stringed instrument, such as a guitar, comprises generally a body, neck, head, and a plurality of strings disposed on or slightly above a top surface of the guitar. More specifically, the strings are attached at one end thereof at the head, extend from there along an entirety of the neck and a portion of the body, and are attached at the other end of the strings to a tremolo (or a vibrato or "whammy") assembly, which is disposed on the top surface of the body. In a typical electric guitar (say, a "Fender® Stratocaster®" style one), a plurality of electronic controls—such as, but not limited to, a volume control, a tone control, and a selector switch—are disposed on the top surface of the body near the tremolo assembly and adapted to be accessed and operated (adjusted) by a user of the guitar.

The known tremolo assembly comprises generally a bridge plate (or base plate or vibrato bar) that is mounted to the guitar at or slightly above the top surface of the body and a tone (or pitch) block that is pivotally coupled to a lower surface of the bridge plate and extends downwardly into a hollow volume defined in an interior of the body. The strings are strung over a top of the bridge plate and, thus, tone block and attached to the bridge plate. The tremolo assembly comprises further a handle a first rod-like part of which is disposed within a portion of the tone block and extends upwardly therefrom and completely through and at least slightly beyond the bridge plate. A second rod-like part of the handle extends from the end of the first rod-like part (that is defined opposite the tone block) and obliquely away with respect to the top surface of the body. A knob is disposed on the end of the second rod-like part (that is defined opposite the first rod-like part). The length of the first rod-like part defines an axis about which the first rod-like part is adapted to rotate within the tone block and bridge plate. In turn, the second rod-like part and, thus, knob are adapted to pivot about the axis.

The user of the guitar may operate the tremolo assembly to vary (amount of) tension in the strings. More specifically, the user may increase the tension in the strings by displacing the handle toward the top surface of the guitar to, thereby, pull the bridge plate away from the body, which, via other mechanisms of the guitar (not described herein, but appreciated by those having ordinary skill in the related art), alters tone (or pitch) of sound produced by playing of the strings by the user (namely, bends the pitch up). Similarly, the user may decrease the tension in the strings by displacing the handle away from the top surface of the guitar to, thereby, push the bridge plate toward the body, which, via the other mechanisms of the guitar, alters the tone of the sound produced by the playing of the strings by the user (namely, bends the pitch down).

The handle of the known tremolo assembly typically is located interferingly adjacent (namely, slightly above—either directly or to either immediate side of) the electronic controls of the guitar. More specifically, the handle typically is located at any given time in a direct path between the controls and the hand of the user that is strumming the guitar and usually responsible for operating the controls. Accordingly, the tremolo assembly typically is "in the way" and interferes with operation of the controls by the user. As a result, the known tremolo assembly typically requires the user to move the handle "out of the way" before he or she accesses and operates the controls. The handle of the known tremolo assembly typically is located also a relatively great distance from the "operating" hand of the user. As such, the known tremolo assembly typically requires the user to inconveniently and time-consumingly reach such distance away from a position from which he or she is comfortably playing the guitar to access the handle so that the user can pivot it. Consequently, the known tremolo assembly typically significantly limits expression of operation by the user of the tremolo assembly and controls.

Thus, there is a need in the related art for a tremolo assembly of a guitar a handle of which typically is not located interferingly adjacent controls of the guitar. More specifically, there is a need in the related art for such a tremolo assembly the handle of which typically is not located also at any given time in a direct path between the controls and a hand of a user of the guitar. There is a need in the related art for such a tremolo assembly also that typically is not "in the way" and does not interfere with operation of the controls by the user. There is a need in the related art for such a tremolo assembly that typically also does not require the user to move the handle "out of the way" before he or she accesses and operates the controls. There is a need in the related art for such a tremolo assembly the handle of which typically is not located also a relatively great distance from the "operating" hand of the user. There is a need in the related art for such a tremolo assembly that typically does not require the user to also inconveniently and time-consumingly reach such distance away from a position from which he or she is comfortably playing the guitar to access the handle so that the user can pivot it. There is a need in the related art for such a tremolo assembly that typically does not also significantly limit expression of operation by the user of the tremolo assembly and controls.

SUMMARY OF INVENTION

The invention overcomes the disadvantages in the related art in a tremolo assembly of a stringed instrument. The stringed instrument defines a hollow volume in an interior of the stringed instrument and includes at least one string, and operation of the tremolo assembly is adapted to vary (amount of) tension in the string. The tremolo assembly comprises a tone block disposed within the hollow volume and operatively connected to the string. An arm extends from the tone block and is disposed within the volume of space. A handle extends from the arm and is spaced from the tone block, and a part of the handle is adapted to be displaced relative to the arm to operatively cause the tone block to correspondingly vary the tension in the string. A bridge plate is attached to a surface of the stringed instrument, connected to the string and tone block, and operatively connected to the arm. An interior of the tone block includes a connection mechanism that extends between the bridge plate and arm, operatively connects the bridge plate to the arm, and is adapted to pull the bridge plate away from and toward the surface of the stringed instrument to correspondingly vary the tension in the string upon the displacement of the part of the handle. The invention overcomes the disadvantages in the related art also in the stringed instrument, which comprises the tremolo assembly.

One advantage of the tremolo assembly of a stringed instrument of the invention is that the handle thereof typically is not located interferingly adjacent controls of the stringed instrument.

Another advantage of the tremolo assembly of a stringed instrument of the invention is that the handle thereof typically is not located at any given time in a direct path between the controls and a hand of a user of the stringed instrument.

Another advantage of the tremolo assembly of a stringed instrument of the invention is that it typically is not "in the way" and does not interfere with operation of the controls by the user.

Another advantage of the tremolo assembly of a stringed instrument of the invention is that it typically does not require the user to move the handle "out of the way" before he or she accesses and operates the controls.

Another advantage of the tremolo assembly of a stringed instrument of the invention is that the handle thereof typically is not located a relatively great distance from the "operating" hand of the user.

Another advantage of the tremolo assembly of a stringed instrument of the invention is that it typically does not require the user to inconveniently and time-consumingly reach a relatively great distance away from a position from which he or she is comfortably playing the stringed instrument to access the handle so that the user can pivot it.

Another advantage of the tremolo assembly of a stringed instrument of the invention is that it typically does not significantly limit expression of operation by the user of the tremolo assembly and controls.

Another advantage of the tremolo assembly of a stringed instrument of the invention is that position of the handle thereof relative to a top surface of the guitar can be selected to accommodate a particular style and comfort of the user in his/her playing of the guitar and/or avoid interference by the handle with access to any of the controls by the user.

Other objects, features, and advantages of the tremolo assembly of a stringed instrument of the invention will be readily appreciated as the tremolo assembly of a stringed instrument becomes more understood while reading the subsequent detailed description of embodiments of the tremolo assembly of a stringed instrument taken in conjunction with the accompanying drawing thereof.

BRIEF DESCRIPTION OF EACH FIGURE OF DRAWING

DETAILED DESCRIPTION OF EMBODIMENTS OF INVENTION

Figure 1:
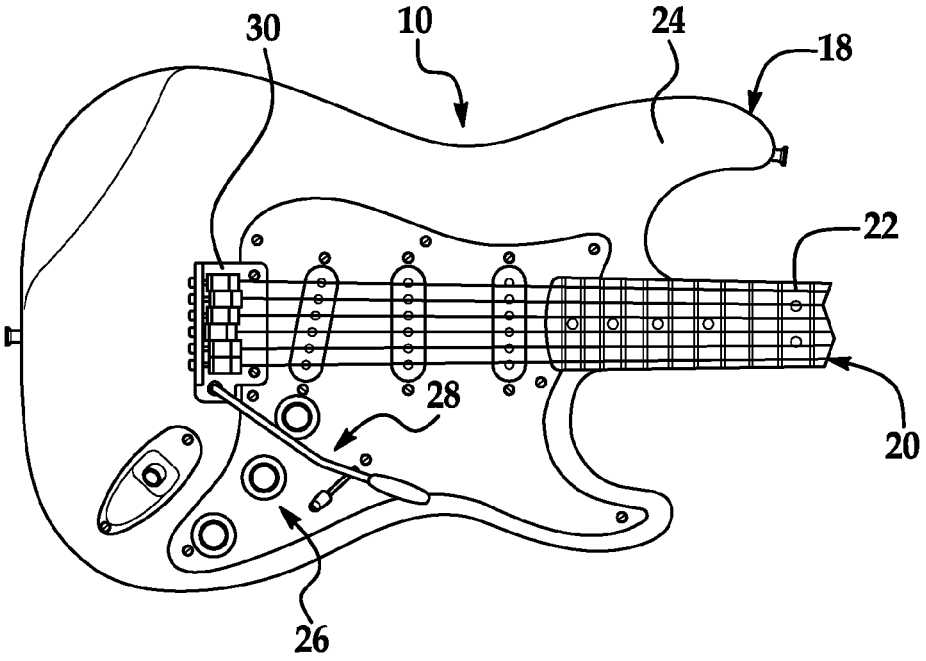
FIG. 1 PRIOR ART
FIG. 1 is an environmental top view of a tremolo assembly of a stringed instrument of the related art showing a handle thereof located slightly above and near electronic controls of a guitar.
Figure 2:
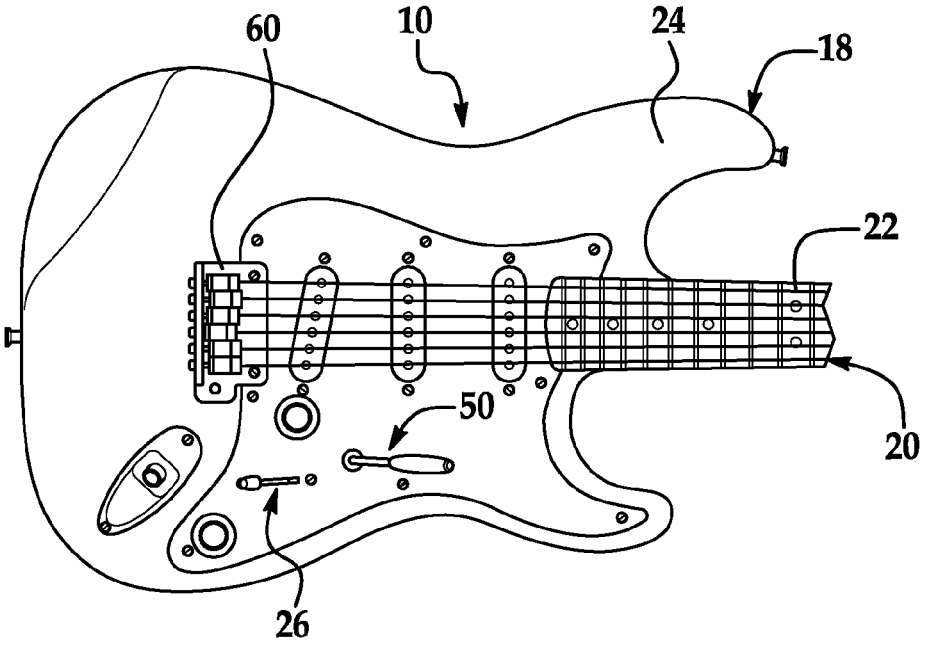
FIG. 2 is an environmental top view of an embodiment of a tremolo assembly of a stringed instrument of the invention showing a handle thereof located away from electronic controls of a guitar.

Referring now to the figures, a tremolo assembly of a stringed instrument of the invention is generally indicated at 50. More specifically, the stringed instrument, generally indicated at 10 in FIGS. 1 and 2, is a guitar 10 that defines an interior, generally indicated at 14 in FIG. 3, of the guitar 10. The interior 14, in turn, defines a hollow volume 16 of the interior 14. The guitar 10 also includes a body, generally indicated at 18, a neck, generally indicated at 20, a head (not shown), and at least one string 22 disposed on or slightly above a top surface 24 of the guitar 10. The top surface 24 is substantially planar and smooth. The hollow volume 16 is defined immediately below the top surface 24 and defines a depth, length, and width of the hollow volume 16 with respect to the interior 14 of the guitar 10—depth of a certain distance toward a bottom surface of the guitar 10, length of a certain distance toward and away from the head of the guitar 10, and width of a certain distance toward sides of the guitar 10.

The guitar 10 shown in each of FIGS. 1 and 2 includes a plurality of—specifically, six—strings 22. The strings 22 are attached at one end of the strings 22 at the head, extend from there along an entirety of the neck 20 and a portion of the body 18, and are attached at the other end of the strings 22 to the tremolo assembly 50, which is disposed on an area of the top surface 24 of the body 18 and described in detail below. Playing of the strings 22 by a user of the guitar 10 is adapted to produce sound. Operation of the tremolo assembly 50 is adapted to vary (amount of) tension in the strings 22, which, in turn, alters tone (or pitch) of the sound. The guitar 10 shown in the figures is an electric guitar 10 and, thus, includes also a plurality of electronic controls, generally indicated at 26, disposed on the top surface 24 of the body 18 and adapted to be accessed and operated (adjusted) by the user of the guitar 10.

Figure 3:
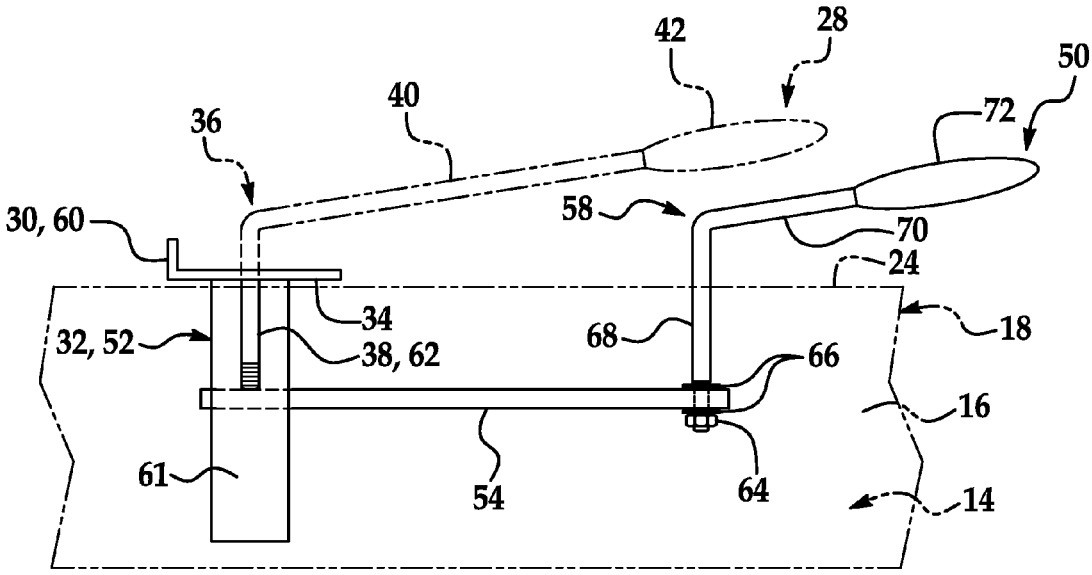
FIG. 3 is a partial environmental sectional side view of the tremolo assembly of a stringed instrument of the related art and embodiment of the tremolo assembly of a stringed instrument of the invention illustrated in FIG. 2 comparing respective placements thereof relative to the body of the guitar.

The guitar 10 shown in FIG. 1 includes also a known tremolo assembly (of the related art), generally indicated at 28. As best shown in FIG. 3, the known tremolo assembly 28 comprises generally a bridge plate 30 that is mounted to the guitar 10 at or slightly above the top surface 24 of the body 18 and a tone block, generally indicated at 32, that is pivotally coupled to an area of a lower surface 34 of the bridge plate 30 and extends downwardly into the hollow volume 16 defined in the interior 14 of the guitar 10. The strings 22 are strung over a top of the bridge plate 30 and, thus, tone block 32 and attached to the bridge plate 30. The known tremolo assembly 28 comprises further a handle, generally indicated at 36, a first rod-like part 38 of which is disposed within a portion of the tone block 32 and extends upwardly therefrom and completely through and at least slightly beyond the bridge plate 30. A second rod-like part 40 of the handle 36 extends from the end of the first rod-like part 38 (that is defined opposite the tone block 32) and obliquely away with respect to the top surface 24 of the body 18. A knob 42 is disposed on the end of the second rod-like part 40 (that is defined opposite the first rod-like part 38). The length of the first rod-like part 38 defines an axis about which the first rod-like part 38 is adapted to rotate within the tone block 32 and bridge plate 30. In turn, the second rod-like part 40 and, thus, knob 42 are adapted to pivot about the axis.

As shown in FIG. 1, the handle 36 of the known tremolo assembly 28 is located slightly above and near and, thus, in the way of the electronic controls 26. In this way, the known tremolo assembly 28 interferes with operation of the electronic controls 26 by the user. As a result, the user is required to move the handle 36 out of the way of the electronic controls 26 so that he or she can access and operate the electronic controls 26. Also, the handle 36 is located a relatively great distance from the hand of the user that is strumming the guitar 10. As such, when the user desires to operate the known tremolo assembly 28 after he or she has operated the electronic controls 26, the user must inconveniently and time-consumingly reach such distance away from a position from which he or she is comfortably playing to access the handle 36 of the known tremolo assembly 28 so that the user can pivot the handle 36. Consequently, expression of operation by the user of the known tremolo assembly 28 and electronic controls 26 is significantly limited.

It should be appreciated by those having ordinary skill in the related art that the tremolo assembly 50 can be employed with any suitable stringed instrument generally, guitar particularly, and electric guitar even more particularly. It should be so appreciated also that the stringed instrument 10 can have any suitable shape, size, and structure and structural elements of the stringed instrument 10 can have any suitable relationship with each other. It should be so appreciated also that the stringed instrument 10, in general, and each structural element of the stringed instrument 10, in particular, can be made of any suitable material. It should be so appreciated also that the tremolo assembly 50 can have any suitable structural relationship with the stringed instrument 10. It should be so appreciated also that, in connection with employment of the tremolo assembly 50 with specifically the electric guitar 10, the electronic controls 26 of the guitar 10 may include any suitable such controls 26—for example, but by no means limited to, a volume control, a tone control, and a selector switch.

Figure 4:
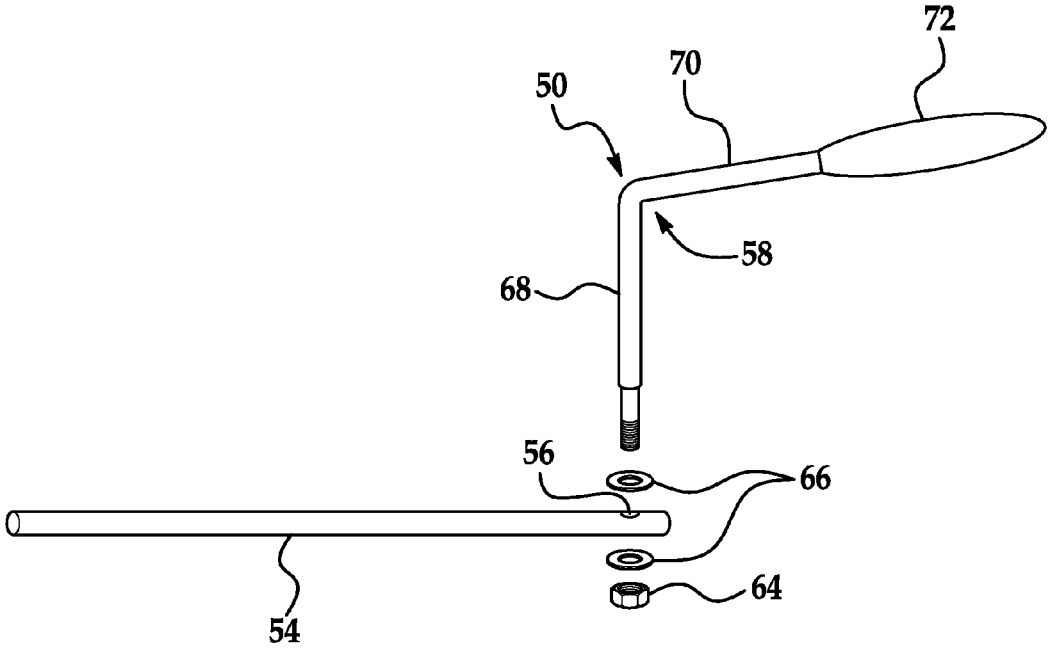
FIG. 4 is an exploded side view of part of the embodiment of the tremolo assembly of a stringed instrument of the invention illustrated in FIG. 2.

Referring now specifically to FIGS. 3 and 4, the tremolo assembly 50 (of the invention) generally comprises a tone block, generally indicated at 52, disposed within the hollow volume 16 of the interior 14 of the body 18 of the guitar 10 and operatively connected to the strings 22. An arm 54 extends from the tone block 52 and is disposed within the hollow volume 16. A handle, generally indicated at 58, extends from the arm 54 and is spaced from the tone block 52, and a part 70 of the handle 58 is adapted to be displaced relative to the arm 54 to operatively cause the tone block 52 to correspondingly vary the tension in the strings 22.

Still referring specifically to FIGS. 3 and 4 and in an embodiment of the tremolo assembly 50, with respect to the tone block 52, the tone block 52 defines a substantially rectangular vertical cross-section of the tone block 52. A top end of the tone block 52 is connected to and disposed slightly above the top surface 24 of the body 18 of the guitar 10. The tone block 52 is disposed substantially perpendicular to the top surface 24 and extends only partially into the hollow volume 16. The tone block 52 also defines an aperture (not shown) disposed completely through the tone block 52 (transversely as viewed in FIG. 3) and adapted to matingly receive an end of the arm 54, as described in greater detail below.

It should be appreciated by those having ordinary skill in the related art that the tone block 52 can have any suitable shape, size, and structure and structural relationship with the remainder of the guitar 10, in general, and hollow volume 16 and top surface 24 of the body 18 of the guitar 10, in particular. It should be so appreciated also that the aperture can define any suitable shape and size and have any suitable relationship with the remainder of the tone block 52 and arm 54. It should be so appreciated also that the tone block 52 can be operatively connected to the strings 22 and top surface 24 in any suitable manner.

With respect to the arm 54, an entirety of the arm 54 is disposed within the hollow volume 16. The arm 54 is substantially rigid, rod-like, and disposed substantially parallel with the top surface 24 and perpendicular to the tone block 52. The diameter of the arm 54 is smaller than the face of the tone block 52 shown in FIG. 3, and the length of the arm 54 is greater than the length of the tone block 52. The arm 54 is connected to a substantially central volume of the tone block 52 such that an end of the arm 54 extends completely through and slightly beyond the tone block 52 (transversely as viewed in FIG. 3) and the other end of the arm 54 is spaced from the tone block 52. As shown in FIG. 4, the other end of the arm 54 also defines a hole 56 disposed completely through the arm 54 (transversely as viewed in the figure) and adapted to matingly receive an end of the handle 58, as described in greater detail below. The arm 54 is disposed closer to the top surface 24 than to the farthest depth of the hollow volume 16.

It should be appreciated by those having ordinary skill in the related art that the arm 54 can have any suitable shape, size, and structure and structural relationship with the remainder of the guitar 10, in general, and hollow volume 16 and top surface 24 of the body 18 of the guitar 10 and tone block 52, in particular. It should be so appreciated also that the hole 56 can define any suitable shape and size and have any suitable relationship with the remainder of the arm 54 and handle 58. It should be so appreciated also that the arm 54 can be connected to the tone block 52 in any suitable manner.

The tremolo assembly 50 comprises further a bridge plate 60 that is attached to the top surface 24 of the guitar 10, connected to the strings 22 and tone block 52, and operatively connected to the arm 54. More specifically, as shown in FIGS. 1 and 2, the bridge plate 60 defines a substantially rectangular horizontal cross-section of the bridge plate 60 and is located on a substantially central area of the top surface 24 of a "tail end" half of the body 18. As shown in FIG. 3, the bridge plate 60 defines a substantially "L-shaped" vertical cross-section of the bridge plate 60 with the short part of the "L" being located opposite the handle 58, extending away from the top surface 24, and being connected to the strings 22. The bridge plate 60 also lies substantially parallel with and slightly above the top surface 24. The bridge plate 60 lies also substantially parallel with the arm 54 and perpendicular to the tone block 52. A bottom surface of the bridge plate 60 rests upon and is connected to a top surface of the tone block 52 such that the ends of the long part of the bridge plate 60 extend substantially symmetrically beyond the corresponding sides of the tone block 52. The length of the long part of the bridge plate 60 is lesser than the length of each of the tone block 52 and arm 54.

It should be appreciated by those having ordinary skill in the related art that the bridge plate 60 can have any suitable shape, size, and structure and structural relationship with the remainder of the guitar 10, in general, and top surface 24 of the body 18 of the guitar 10 and tone block 52, in particular. It should be so appreciated also that the bridge plate 60 can be connected to the tone block 52 in any suitable manner.

With respect to operative connection of the bridge plate 60 to the arm 54, an interior 61 of the tone block 52 includes a connection member or mechanism 62 that extends between and is connected to the bottom surface of the bridge plate 60 and an upper surface of the arm 54, operatively connects the bridge plate 60 to the arm 54, and is adapted to pull the bridge plate 60 away from and toward the top surface 24 of the guitar 10 to correspondingly vary the tension in the strings 22 upon displacement of the part 70 (which is described in more detail below) of the handle 58 toward and away from the top surface 24 of the guitar 10. To this end, an end of the connection mechanism 62 is matingly received through an orifice (not shown) defined in the top surface 24. In the embodiment of the tremolo assembly 50 shown, the connection mechanism 62 is a set screw 62, with the threads of the set screw 62 disposed on the end of the set screw 62 located adjacent the arm 54. The set screw 62 is disposed substantially symmetrical with respect to the length of the interior 61 of the tone block 52, parallel with the length of the tone block 52, and substantially perpendicular to the length of the top surface 24, arm 54, and bridge plate 60. The length of the set screw 62 is lesser than the length of each of the tone block 52, arm 54, and long part of the bridge plate 60.

It should be appreciated by those having ordinary skill in the related art that the connection mechanism 62 can have any suitable shape, size, and structure and structural relationship with the remainder of the guitar 10, in general, and top surface 24 of the body 18 of the guitar 10, tone block 52, arm 54, and bridge plate 60, in particular. It should be so appreciated also that the orifice can define any suitable shape and size and have any suitable relationship with the remainder of the top surface 24 and connection mechanism 62. It should be so appreciated also that the connection mechanism 62 can be connected to the arm 54 and bridge plate 60 in any suitable manner. It should be so appreciated also that the connection mechanism 62 can pull the bridge plate 60 away from and toward the top surface 24 of the guitar 10 to correspondingly vary the tension in the strings 22 upon displacement of the part 70 of the handle 58 in any suitable manner. It should be so appreciated also that the connection mechanism 62 can be any suitable type of connection mechanism 62. It should be so appreciated also that the bridge plate 60 can be pulled away from and toward the top surface 24 of the guitar 10 to correspondingly vary the tension in the strings 22 upon displacement of the part 70 of the handle 58 in any suitable manner.

With respect to the handle 58 and as best shown in FIG. 4, the handle 58 is swivelingly fastened to the arm 54 to allow the part 70 of the handle 58 to be selectively positioned relative to the top surface 24. More specifically, the part 70 is adapted to be rotated about an axis defined by the length of another part 68 (which is described in more detail below) of the handle 58 such that the part 70 can be selectively positioned practically anywhere on an imaginary "plane" swept out by the second part 70 about the other part 68 a height above the top surface 24. In this way, the selected position of the second part 70 can accommodate a particular style and comfort of the user in his/her playing of the guitar 10 and/or avoid interference by the second part 70 with access to any of the electronic controls 26 by the user. In the embodiment of the tremolo assembly 50 shown in the figure, the handle 58 is swivelingly fastened to the arm 54 via at least a nut 64, with the corresponding end of the arm 54 being sandwiched between a pair of washers 66 and the nut 64 being disposed underneath and in contacting relationship with the lower washer 66.

Referring to FIGS. 3 and 4, the handle 58 is also substantially rigid and includes the first "rod-like" part 68 extending substantially vertically from this end of the arm 54 and the second "rod-like" part 70 extending from an end of the first part 68 defined opposite the arm 54 away from the tone block 52 and obliquely away with respect to the guitar 10. The shorter angle defined between the first and second parts 68, 70 is greater than ninety degrees. The end of the first part 68 is matingly received through another orifice (not shown) defined in the top surface 24. In this way, the first part 68 of the handle 58 is disposed partially within the hollow volume 16 of the interior 14 of the guitar 10 and extends upwardly from the hollow volume 16 and completely through and at least slightly beyond the top surface 24 of the guitar 10. The length of the first part 68 is substantially equal to the length of the second part 70.

It should be appreciated by those having ordinary skill in the related art that the handle 58, in general, and each of the first and second parts 68, 70 of the handle 58, in particular, can have any suitable shape, size, and structure and structural relationship with the remainder of the guitar 10, in general, and top surface 24 of the body 18 of the guitar 10 and each other, in particular. It should be so appreciated also that the shorter angle defined between the first and second parts 68, 70 can be any suitable number of degrees, up to and including 180 degrees. It should be so appreciated also that the other orifice can define any suitable shape and size and have any suitable relationship with the remainder of the top surface 24 and handle 58. It should be so appreciated also that the handle 58 can be swivelingly fastened to the arm 54 in any suitable manner. It should be so appreciated also that the second part 70 can be rotated about the axis of the first part 68 of the handle 58 any suitable number of degrees and height above the top surface 24 of the guitar 10.

A knob 72 is disposed on an end of the handle 58 defined opposite the arm 54 and extends away from the arm 54. It should be appreciated by those having ordinary skill in the related art that the knob 72 can have any suitable shape, size, and structure and structural relationship with the handle 58, in general, and second part 70 of the handle 58, in particular. It should be so appreciated also that the knob 72 can be disposed on the handle 58 in any suitable manner. It should be so appreciated also that the handle 58 may not include the knob 72.

In the embodiment of the tremolo assembly 50 described above and shown in the figures, each of the arm 54 and handle 58 is made of stainless steel. In this way, the handle 58 does not need to be finished. Also, the diameter of the arm 54 is substantially one-fourth inch, and the diameter of the handle 58 is substantially three-sixteenths inch, which is a common size for a "Fender® Stratocaster®" style electric guitar. And, the washers 66 are made of nylon so as to permit the handle 58 to swivel substantially smoothly relative to the arm 54. Furthermore, the nut 64 is of a self-locking type, such as a "Nylok®" brand lock nut, that will not loosen from swiveling of the handle 58 relative to the arm 54.

However, it should be appreciated by those having ordinary skill in the related art that the tremolo assembly 50, in general, and each of the tone block 52, arm 54, handle 58, bridge plate 60, connection mechanism 62, nut 64, washers 66, and knob 72, in particular, can be made of any suitable material. By way of example only and not limitation, the arm 54 and/or handle 58 can be made of chromed steel or aluminum. It should be so appreciated also that the handle 58 can be finished or not. It should be so appreciated also that the diameter of each of the arm 54 and handle 58 can be any suitable size. It should be so appreciated also that the washers 66 can be made of any suitable material so as to permit the handle 58 to swivel relative to the arm 54. It should be so appreciated also that the nut 64 can be of any suitable type.

In operation of the tremolo assembly 50, the user of the guitar 10 varies the tension in the strings 22. More specifically, the user may increase the tension in the strings 22 by displacing the second part 70 of the handle 58 of the tremolo assembly 50 away from the top surface 24 of the body 18 of the guitar 10 to, thereby, pull the bridge plate 60 toward the body 18 of the guitar 10, which, via other mechanisms of the guitar 10 (not described herein, but appreciated by those having ordinary skill in the related art), alters tone (or pitch) of the sound produced by playing of the strings 22 by the user (namely, bends the pitch up). Similarly, the user may decrease the tension in the strings 22 by displacing the second part 70 of the handle 58 toward the top surface 24 to, thereby, push the bridge plate 60 away from the body 18, which, via the other mechanisms of the guitar 10, alters the tone of the sound produced by the playing of the strings 22 by the user (namely, bends the pitch down). At any time, the user can swivel the handle 58 to selectively position the second part 70 relative to the top surface 24. By so doing, the selected position of the second part 70 can accommodate the particular style and comfort of the user in his/her playing of the guitar 10 and/or avoid interference by the second part 70 with access to any of the electronic controls 26 by the user.

The invention also contemplates the stringed instrument 10 that comprises the tremolo assembly 50 and is described in detail above. In this respect, it should be appreciated by those having ordinary skill in the related art that the stringed instrument 10 is a guitar 10 preferably and an electric guitar 10 even more preferably.

The handle 58 of the tremolo assembly 50 typically is not located interferingly adjacent the controls 26 of the guitar 10. Also, the handle 58 typically is not located at any given time in a direct path between the controls 26 and a hand of the user. And, the tremolo assembly 50 typically is not "in the way" and does not interfere with operation of the controls 26 by the user. Furthermore, the tremolo assembly 50 typically does not require the user to move the handle 58 "out of the way" before he or she accesses and operates the controls 26. In addition, the handle 58 typically is not located a relatively great distance from the "operating" hand of the user. Moreover, the tremolo assembly 50 typically does not require the user to inconveniently and time-consumingly reach a relatively great distance away from a position from which he or she is comfortably playing the guitar 10 to access the handle 58 so that the user can pivot the handle 58. Plus, the tremolo assembly 50 typically does not significantly limit expression of operation by the user of the tremolo assembly 50 and controls 26. Position of the handle 58 relative to the top surface 24 of the guitar 10 can be selected to accommodate the particular style and comfort of the user in his/her playing of the guitar 10 and/or avoid interference by the handle 58 with access to any of the electronic controls 26 by the user as well.

The tremolo assembly 50 has been described in an illustrative manner. It is to be understood that the terminology that has been used is intended to be in the nature of words of description rather than of limitation. Many modifications and variations of the tremolo assembly 50 are possible in light of the above teachings. Therefore, within the scope of the appended claims, the tremolo assembly 50 may be practiced other than as specifically described.

What is claimed is:

1. A tremolo assembly of a stringed instrument, wherein the stringed instrument defines a hollow volume in an interior of the stringed instrument and includes at least one string and operation of said tremolo assembly is adapted to vary tension in the string, said tremolo assembly comprising:

a tone block disposed within said hollow volume and operatively connected to said string;

an arm extending from said tone block and disposed within said volume of space;

a handle extending from said arm and spaced from said tone block and a part of said handle being adapted to be displaced relative to said arm to operatively cause said tone block to correspondingly vary the tension in the string; and a bridge plate that is attached to a surface of the stringed instrument, connected to said string and tone block, and operatively connected to said arm, wherein an interior of said tone block includes a connection mechanism that extends between said bridge plate and arm, operatively connects said bridge plate to said arm, and is adapted to pull said bridge plate away from and toward the surface of the stringed instrument to correspondingly vary the tension in the string upon the displacement of said part of said handle.

2. Said tremolo assembly as set forth in claim 1, wherein an entirety of said arm is disposed within said volume of space.

3. Said tremolo assembly as set forth in claim 1, wherein said connection mechanism is a set screw.

4. Said tremolo assembly as set forth in claim 1, wherein the surface is a top surface of a body of the stringed instrument.

5. Said tremolo assembly as set forth in claim 4, wherein said handle is swivelingly fastened to said arm to allow said handle to be selectively positioned relative to said top surface.

6. Said tremolo assembly as set forth in claim 1, wherein said part of said handle is a second part thereof and said handle includes also a first part thereof extending from said arm and said second part extends from an end of said first part defined opposite said arm away from said tone block and obliquely away with respect to the stringed instrument.

7. Said tremolo assembly as set forth in claim 6, wherein said first part of said handle is disposed partially within said hollow volume of said interior of the stringed instrument and extends upwardly therefrom and completely through and at least slightly beyond an exterior surface of the stringed instrument.

8. Said tremolo assembly as set forth in claim 1, wherein a knob is disposed on an end of the handle defined opposite said arm.

9. A stringed instrument comprising:

a hollow volume defined in an interior of said stringed instrument;

at least one string; and a tremolo assembly operation of which is adapted to vary tension in said string and including:

a tone block disposed within said hollow volume and operatively connected to said string;

an arm extending from said tone block and disposed within said volume of space;

a handle extending from said arm and spaced from said tone block and a part of said handle being adapted to be displaced relative to said arm to operatively cause said tone block to correspondingly vary the tension in said string, and a bridge plate that is attached to a surface of said stringed instrument, connected to said string and tone block, and operatively connected to said arm, wherein an interior of said tone block includes a connection mechanism that extends between said bridge plate and arm, operatively connects said bridge plate to said arm, and is adapted to pull said bridge plate away from and toward said surface of said stringed instrument to correspondingly vary the tension in said string upon the displacement of said part of said handle.

10. Said stringed instrument as set forth in claim 9, wherein an entirety of said arm is disposed within said volume of space.

11. Said stringed instrument as set forth in claim 9, wherein said connection mechanism is a set screw.

12. Said stringed instrument as set forth in claim 9, wherein said surface is a top surface of a body of said stringed instrument.

13. Said stringed instrument as set forth in claim 12, wherein said handle is swivelingly fastened to said arm to allow said handle to be selectively positioned relative to said top surface.

14. Said stringed instrument as set forth in claim 9, wherein said part of said handle is a second part thereof and said handle includes also a first part thereof extending from said arm and said second part extends from an end of said first part defined opposite said arm away from said tone block and obliquely away with respect to said stringed instrument.

15. Said stringed instrument as set forth in claim 14, wherein said first part of said handle is disposed partially within said hollow volume of said interior of said stringed instrument and extends upwardly therefrom and completely through and at least slightly beyond an exterior surface of said stringed instrument.

16. Said stringed instrument as set forth in claim 9, wherein a knob is disposed on an end of the handle defined opposite said arm.

* * * * *